US008343357B2

(12) United States Patent
Horner

(10) Patent No.: US 8,343,357 B2
(45) Date of Patent: Jan. 1, 2013

(54) STREET CURB INLET PROTECTION

(75) Inventor: Stuart Richard Horner, Gonzales, TX (US)

(73) Assignee: Horner Industries, LLC, Gonzales, TX (US)

( * ) Notice: Subject to any disclaimer, the term of this patent is extended or adjusted under 35 U.S.C. 154(b) by 301 days.

(21) Appl. No.: 12/804,695

(22) Filed: Jul. 27, 2010

(65) Prior Publication Data

US 2011/0024340 A1 Feb. 3, 2011

Related U.S. Application Data

(60) Provisional application No. 61/271,976, filed on Jul. 29, 2009.

(51) Int. Cl.
*E03F 5/06* (2006.01)
*E03F 5/14* (2006.01)

(52) U.S. Cl. ..... 210/747.3; 210/162; 210/163; 210/170.03; 210/232; 210/480; 404/4

(58) Field of Classification Search ..... 210/747.2, 210/747.3, 767, 162, 163, 170.03, 232, 474, 210/479, 480; 404/4, 5
See application file for complete search history.

(56) References Cited

U.S. PATENT DOCUMENTS 5,133,619 A 7/1992 Murfae
5,403,474 A 4/1995 Emery
5,405,539 A * 4/1995 Schneider ..... 210/163
5,643,445 A * 7/1997 Billias et al. ..... 210/162
5,954,952 A 9/1999 Strawser, Sr.
6,017,166 A 1/2000 Mossburg, Jr.
6,086,758 A * 7/2000 Schilling et al. ..... 404/4
6,149,803 A * 11/2000 DiLoreto et al. ..... 210/170.03
6,165,357 A * 12/2000 Cormier ..... 210/163
6,231,758 B1 5/2001 Morris
6,254,770 B1 * 7/2001 Remon ..... 210/163
6,402,942 B2 6/2002 Cardwell et al.
6,709,579 B1 3/2004 Singleton
6,811,708 B2 11/2004 Shaw et al.
6,824,677 B2 11/2004 Martinez
6,869,526 B2 3/2005 Sharpless
6,884,343 B2 4/2005 Harris et al.
6,974,540 B1 12/2005 Fleischmann
7,070,691 B2 7/2006 Lindemulder
7,074,326 B2 7/2006 Singleton
7,131,787 B2 11/2006 McGinn
7,156,987 B1 1/2007 Sanguinetti
7,160,048 B1 1/2007 Fattori et al.
7,179,371 B1 2/2007 Bistline
7,208,082 B2 4/2007 Hurst et al.
7,246,968 B1 7/2007 Priest
7,300,574 B1 11/2007 Lewis
7,357,861 B2 4/2008 Kelley et al.
7,438,802 B2 10/2008 Hurst
7,670,483 B2 * 3/2010 Ringenbach et al. ..... 210/163
7,922,916 B1 * 4/2011 Witt ..... 210/747.3
2003/0047497 A1 3/2003 Harris et al.
2003/0173277 A1 9/2003 Shaw et al.
2004/0069697 A1 4/2004 Martinez
2006/0124520 A1 6/2006 Hurst
2008/0105603 A1 5/2008 Hurst

* cited by examiner

*Primary Examiner* — Christopher Upton
(74) *Attorney, Agent, or Firm* — Michael A. Ervin; M. A. Ervin & Associates

(57) ABSTRACT

A device and method for filtering storm water entering a street curb inlet drain using a series of expandable brackets to deploy and seal a filter medium completely inside a street curb inlet drain.

18 Claims, 8 Drawing Sheets

STREET CURB INLET PROTECTION

CROSS REFERENCE TO RELATED APPLICATIONS

This application claims the priority date of U.S. Provisional 61/271,976 filed on Jul. 29, 2009.

BACKGROUND OF THE INVENTION

This invention relates to a street curb inlet filter, and more particularly to a street curb inlet filter for filtering out dirt and other contaminants from flowing into a street curb inlet.

Water flowing into a street curb drain carries erosion, leaves, grass clipping, floatable, and assorted trash into the drain, often clogging the storm sewer lines and allowing unwanted contamination into downstream creeks, rivers, lakes, aquifers, reservoirs, canals, or the sea. The environmental damage and financial costs of clean up from storm drains is enormous.

Debris and pollutants in runoff water are relatively heavy at construction sites, so sandbags are typically piled around a curb drain inlet as a filter. However, although sandbags block large debris, they impede water flow and do not effectively filter the flow.

Numerous solutions have been proposed to solve this problem. Straw wattles and hay bales have been used to filter out sediment and other solids flowing into a street curb inlet storm drain. Additionally, stones have been wrapped in chicken wire and placed in front of a street curb inlet type storm drain. The straw wattle and hay bail type of sediment filters often get clogged and are often not reusable. Also, they may decompose and slip into the storm drain. This could cause further clogging. Furthermore, the method using stones and chicken wire (stone bundles) does not filter out as large amount of sediment and other solids as do other methods. Also, these stone bundles break and fall into the drains, and can also be a safety hazard for children.

More sophisticated street curb inlet filter shave been proposed. Fleischmann (U.S. Pat. No. 6,974,540) describes a curb drain filter comprised of U-shaped brackets for attaching to an inside wall of a street curb drain adjacent an inlet. This approach has an internal supported debris basin with a filter media pack to collect debris. Kelly (U.S. Pat. No. 7,357,861) describes a street curb inlet filter with a filter body which includes a, substantially rigid, elongated frame and an elongated filter cover formed around at least one of the sides of the frame, wherein the filter cover is formed of a filtration material to filter out sediments and the like. Hurst (U.S. Pat. No. 7,438,802) describes a storm drain filter that includes a filter panel with a frame that holds a bristle filter in a configuration to filter incoming drainage water. The bristle filter includes a plurality of bristles arranged approximately perpendicular to the street surface. The bristles are arranged closely together to filter sediment from drainage water. The assembly protrudes partially out of the inlet and thus needs to be rotated out of the way during street cleaning.

These prior art attempts have often not been adopted by municipalities primarily because of their complexity, degree of difficulty in installation, their need for ongoing maintenance, and in some cases the difficulty of street cleaning unless the inlet protection device is first removed.

What is needed then is a more rigorous and easier to install and use inlet protection device, that effectively filters all of the drain water, is relatively hidden from view and does not require frequent maintenance nor removal for street cleaning.

BRIEF SUMMARY OF THE INVENTION

This need is met with a new inlet protection device that uses simple mechanical brackets and filter material to capture all dirt and debris before it enters a storm water inlet. This is accomplished by use of a bracket structure that applies uniform pressure against the structure inside of the street curb inlet to create a seal.

The need is met with an expandable street curb inlet filter for filtering debris flowing into a street curb inlet having a top and a base, including at least: a rigid frame strut having a first guided sleeve pivotally attached on a first end and rigidly connected at a second end to a first extended rod; a rigid compression strut pivotally connected at a first end at a point between the first and second end of the rigid frame strut and fixedly connected at its second end to a second extended rod; a second guided sleeve pivotally attached between the first end and the second end of the rigid compression strut; the second guided sleeve fixedly attached to a threaded nut; a threaded fastener passing through the first guided sleeve and the threaded nut of the second guided sleeve; a filter medium attached fixedly between the first and second extended rods; wherein the threaded fastener, when tightened, moves the rigid compression strut upwards in a reverse scissor movement to separate the first and second extended rods and deploy the filter medium and seal the first and second rods against the top and base of the street curb inlet.

In another aspect the need is met with an expandable curb inlet filter for filtering debris flowing into a street curb inlet having a top and a base, including at least: a rigid frame strut having a first guided sleeve pivotally attached on a first end and fixedly connected at a second end to a first extended rod; a rigid compression strut pivotally connected at a first end at a point between the first and second end of the rigid frame strut and fixedly connected at its second end to a second extended rod; a second guided sleeve pivotally attached between the first end and the second end of the rigid compression strut; a threaded turnbuckle assembly connected to the first guided sleeve and the second guided sleeve; a filter medium attached fixedly between the first and second extended rods; wherein the threaded turnbuckle assembly, when tightened, moves the rigid compression strut upwards in a reverse scissor movement to separate the first and second extended rods and deploy the filter medium and seal the first and second rods against the top and base of the street curb inlet.

In another aspect the need is met with an expandable street curb inlet filter for filtering debris flowing into a street curb inlet having a top and a base, including at least: a rigid frame strut having a first guided sleeve pivotally attached on a first end and rigidly connected at a second end to a first extended rod; the first guided sleeve fixedly attached to a threaded nut; a rigid compression strut pivotally connected at a first end at a point between the first and second end of the rigid frame strut and fixedly connected at its second end to a second extended rod; a second guided sleeve pivotally attached between the first end and the second end of the rigid compression strut; a threaded fastener passing through the second guided sleeve and the threaded nut of the first guided sleeve; a filter medium attached fixedly between the first and second extended rods; wherein the threaded fastener, when tightened, moves the rigid compression strut upwards in a reverse scissor movement to separate the first and second extended rods and deploy the filter medium and seal the first and second rods against the top and base of the street curb inlet.

In another aspect the need is met by a method for filtering debris flowing into a street curb inlet having a top and a base, including at least the steps of: providing a rigid frame strut having a first guided sleeve pivotally attached on a first end and fixedly connected at a second end to a first extended rod; providing a rigid compression strut pivotally connected at a first end at a point between the first and second end of the rigid frame strut and fixedly connected at its second end to a second extended rod; providing a second guided sleeve pivotally attached between the first end and the second end of the rigid compression strut; providing a filter medium attached fixedly between the first and second extended rods; providing a driving force that moves the rigid compression strut upwards in a reverse scissor movement to separate the first and second extended rods and deploy the filter medium and seal the first and second rods against the top and base of the street curb inlet.

DETAILED DESCRIPTION OF THE INVENTION

Figure 1:
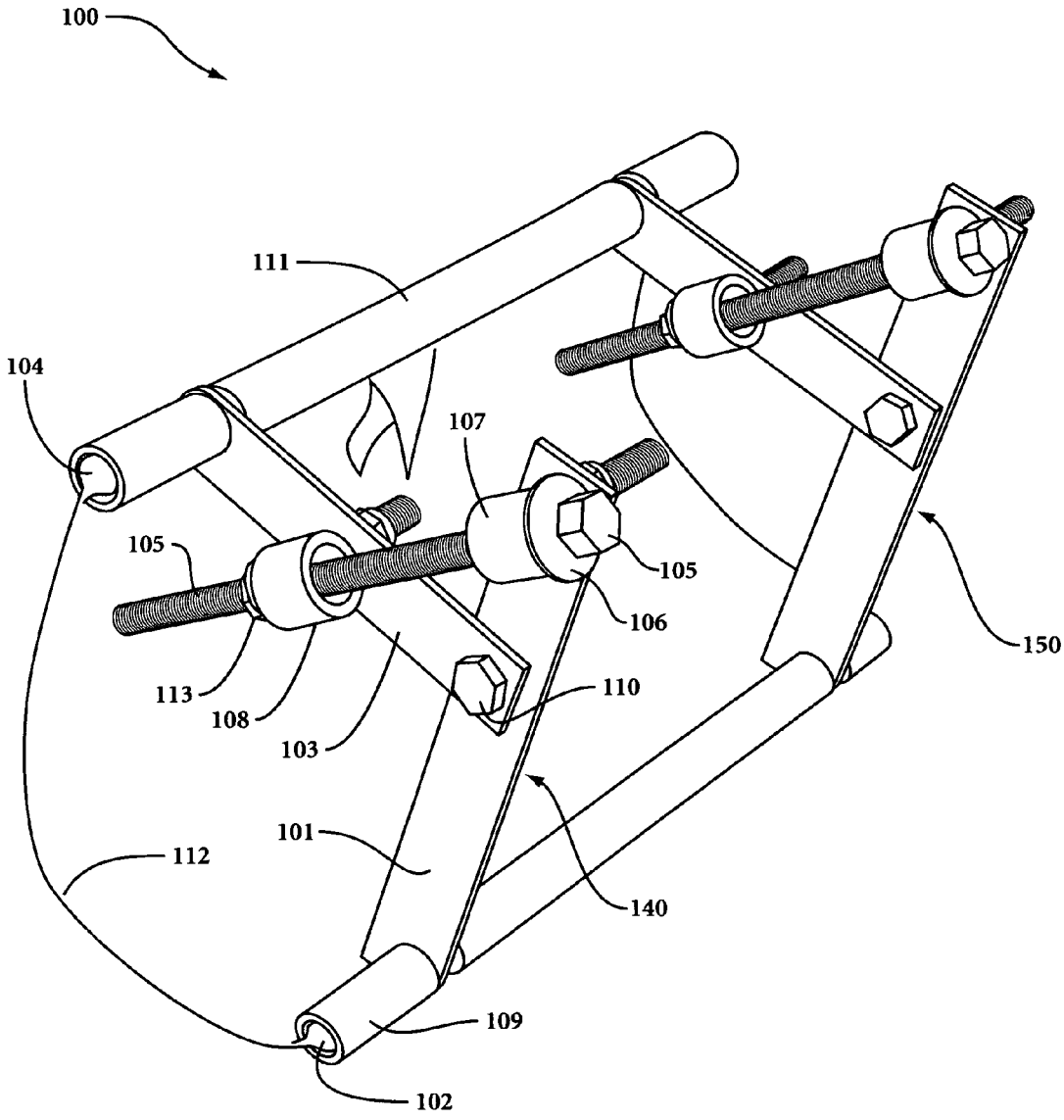
FIG. 1 is an overall view of an embodiment of the expandable street curb inlet filter.
Figure 2:
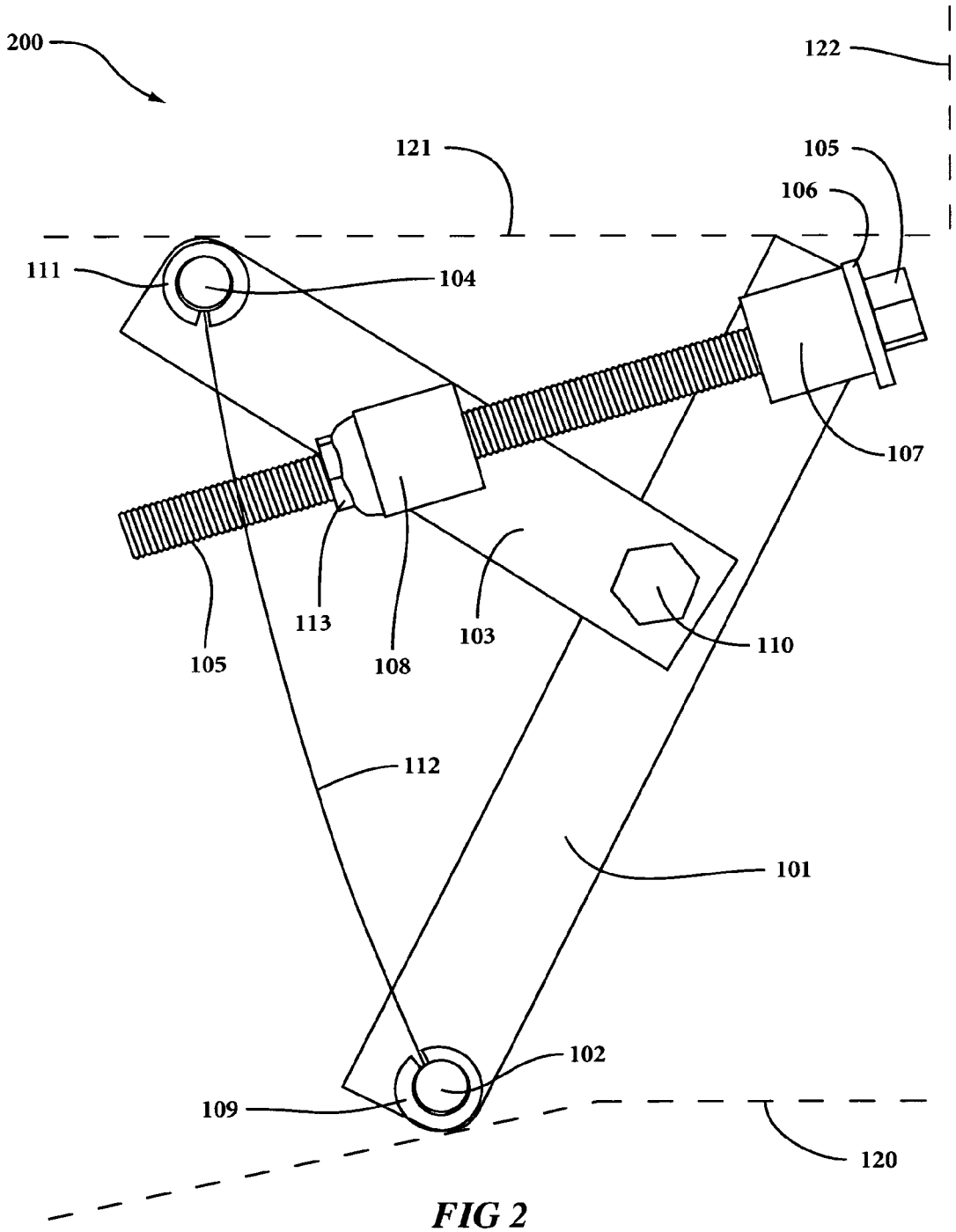
FIG. 2 illustrates an embodiment of an individual bracket of the expandable street curb inlet filter.

A street curb inlet filter of the described invention is shown generally by the numeral 100 in FIG. 1. A filter medium 112 is attached between extended rods 102 and 104. The filter medium 112 can be held in place by a surrounding elastomeric sleeve (111 on rod 104 and 109 on rod 102). The filter medium can be any material suitable for filtering, depending on the application. For example a useful medium is landscape fabric—a synthetic fabric made from plastic fiber such as polypropylene. Alternately a wire mesh fabric can be used as the filter medium. Rods 102 and 104 may be circular cylinders or other shapes, and can be metal or hardened polymer. Elastomeric sleeves 111 and 109 may be as simple as a rubber hose that is cut with a lengthwise slit to fit around rods 102 and 104, but could be other elastomeric materials. Shown in FIG. 1 and in more detail in FIG. 2 are two expander brackets 140 and 150 that serve as a mechanism to implement the function of the street curb inlet filter. A rigid frame strut 101 has a guided sleeve 107 pivotally connected near a first end and is fixedly connected at the second end to extended rod 102. Guided sleeve 107 could be as simple as an eyebolt but could be other configurations that allow a threaded fastener 105, such as a threaded bolt to feed through it. A structure 106 to which threaded fastener 105 tightens against could be as simple as a washer or could be designed as a part of guided sleeve 107. A rigid compression strut 103 is pivotally connected at a first end at a point between the first and second end of rigid frame strut 101 and is fixedly connected at its second end to extended rod 104. A second guided sleeve 108 is pivotally attached between the first and second ends of rigid strut 103 and has a fixed threaded nut 113 through which threaded fastener 105 can be tightened.

In operation street curb inlet filter 100 can be easily inserted into a street curb inlet in a collapsed mode and then the threaded fasteners 105 can be tightened with an appropriate tool, or by hand, pulling compression strut 103 upwards in a reverse scissor movement, spreading the assembly until it is locked into place in the street curb inlet, with rods 102 and 104 sealing off against the top 121 and bottom 120 of the street curb inlet. The inlet filter 100 is placed into the street curb inlet behind the face 122 of the curb so that no part of the system protrudes past the face 122 of the street curb inlet. When the torque force on threaded fastener 105 is set properly the street curb inlet filter 100 can withstand the force of incoming water and accompanying debris.

The street curb inlet filter of FIG. 1 is shown with only two expander brackets (140 and 150). In practice street curb inlet filter 100 may be much longer and have multiple expander brackets. It has been found that expander brackets approximately every 12 inches provides a good design choice for robust operation.

Figure 3:
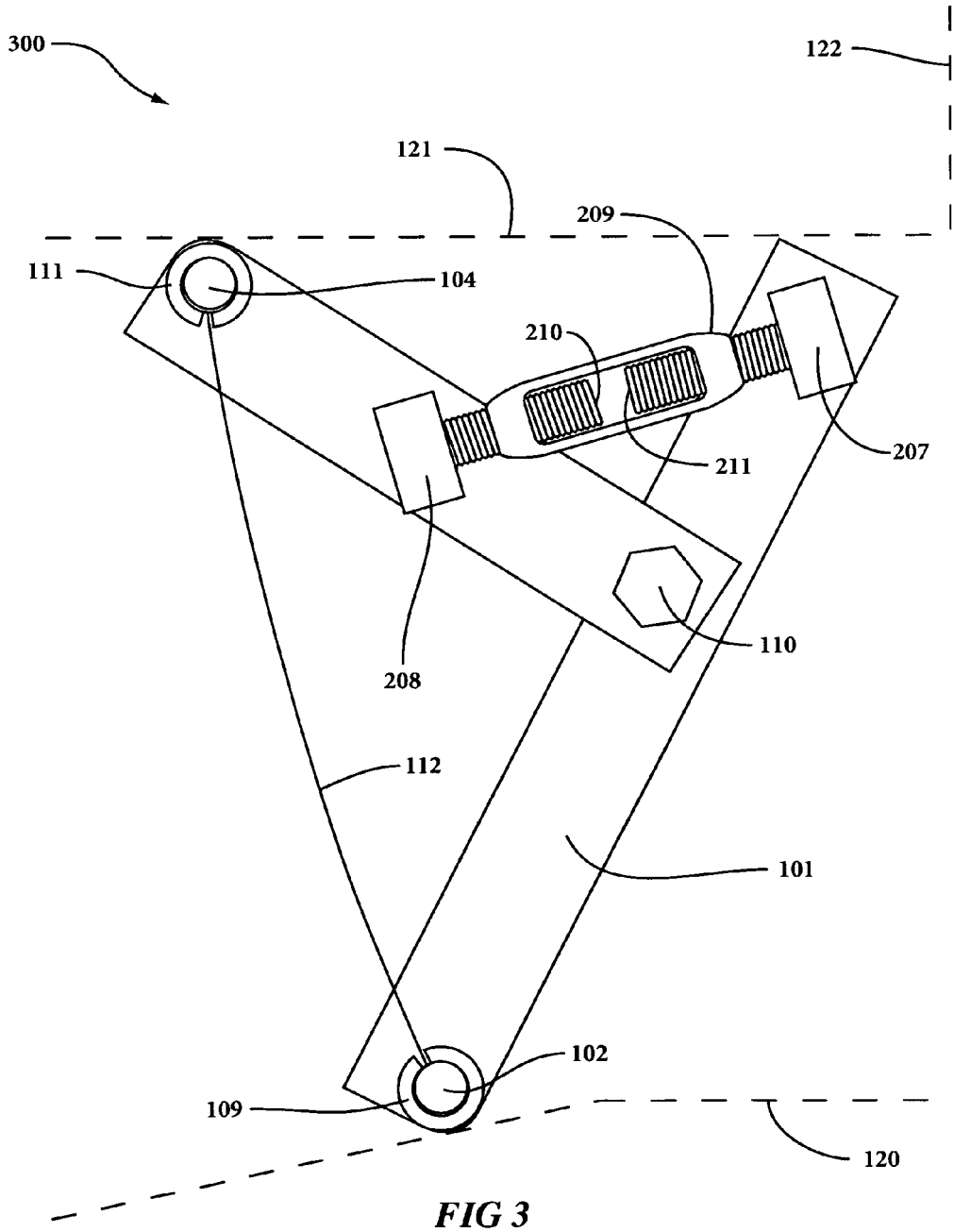
FIG. 3 illustrates another embodiment of an individual bracket of the expandable street curb inlet filter.

A number of design options exist for providing the driving force for expanding the brackets 140 and 150 of FIG. 1. An alternate embodiment is shown in FIG. 3 in which instead of the threaded fastener 105 and threaded nut 109 combination of FIG. 2 a similar compression force could be obtained by replacing the threaded fastener of FIG. 2 with a center turnbuckle 209 coupled to two threaded rods 210 and 211 pivotally attached at 207 and 208. Any of these threaded fastener options are anticipated as part of this invention. Turnbuckle 209 has left hand screw threads on one end and right hand screw threads on the other so that simply turning turnbuckle 209 will apply the necessary force to pull the compression strut upwards in a reverse scissor movement until it locks the street curb inlet filter in place in the street curb inlet in the same way as the design in FIG. 2. The invention of this disclosure anticipates any threaded fastener (or turnbuckle) that can perform this function of expanding the brackets to seal the street curb inlet filter against the top 121 and bottom 120 of the street curb inlet.

Brackets 140 and 150 could also be expanded without the use of threaded fasteners by the use of installed springs (not shown) that provide the force for expanding the brackets in order to lock the street curb inlet filter into place. In that aspect the street curb inlet filter would be inserted into the street curb inlet with the springs compressed and once properly placed the springs would be released to expand brackets 140 and 150 and lock the street curb inlet filter into place.

Figure 4:
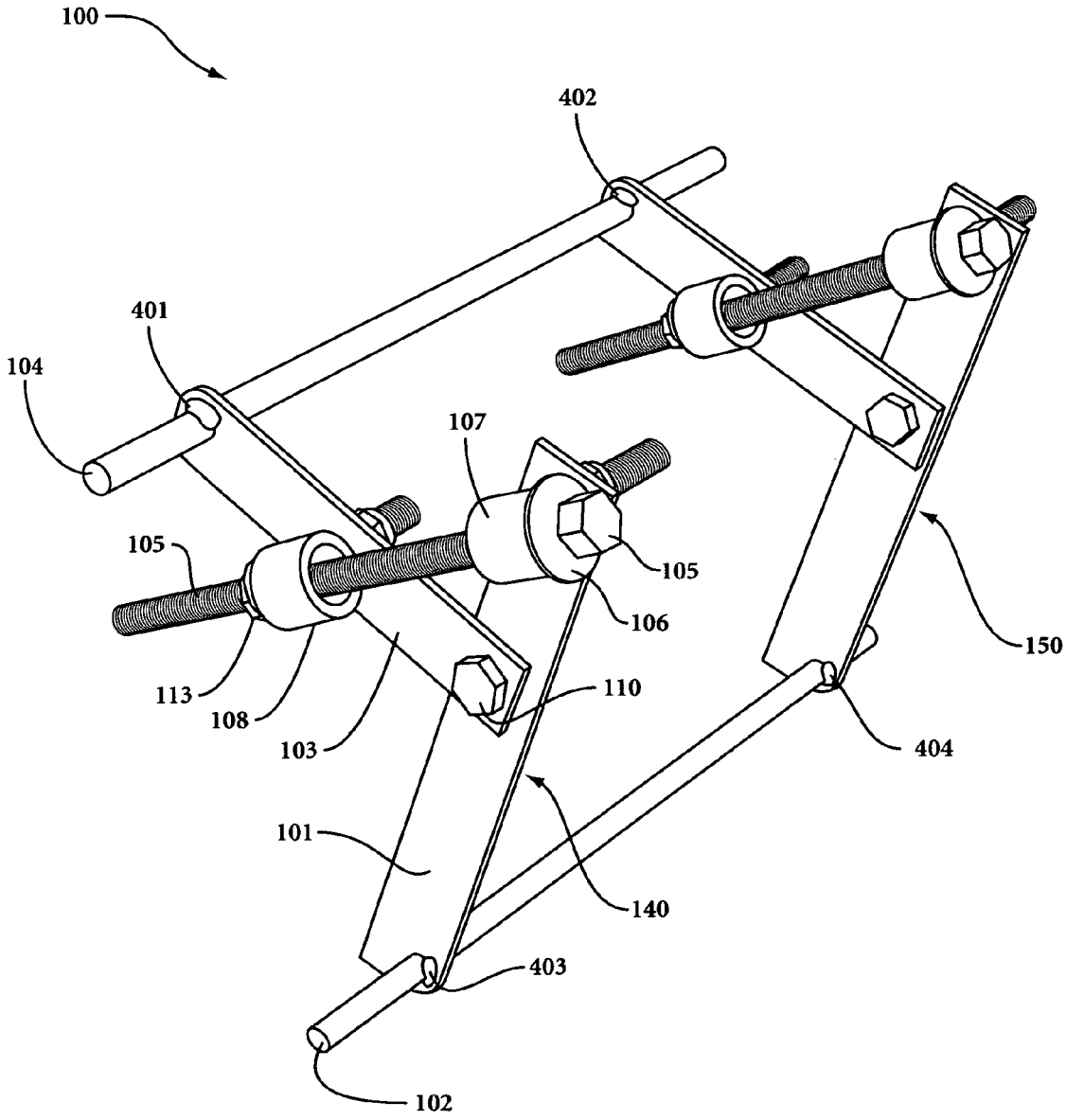
FIG. 4 illustrates an overall view of an embodiment of the expandable street curb inlet filter shown without the filter medium and elastomeric sleeves.

FIG. 4 is an alternate view of FIG. 1 with filter medium 112 and elastomeric sleeves 109 and 111 have been removed to illustrate the brackets better. Struts 101 and 103 are shown attached to extended rods 104 and 102 and fixed with welds 401 and 403. Similar welds are sown at 402 and 404. Other design choices could be used to fixedly attach the struts to the extended rods and they are anticipated by this invention.

Figure 5:
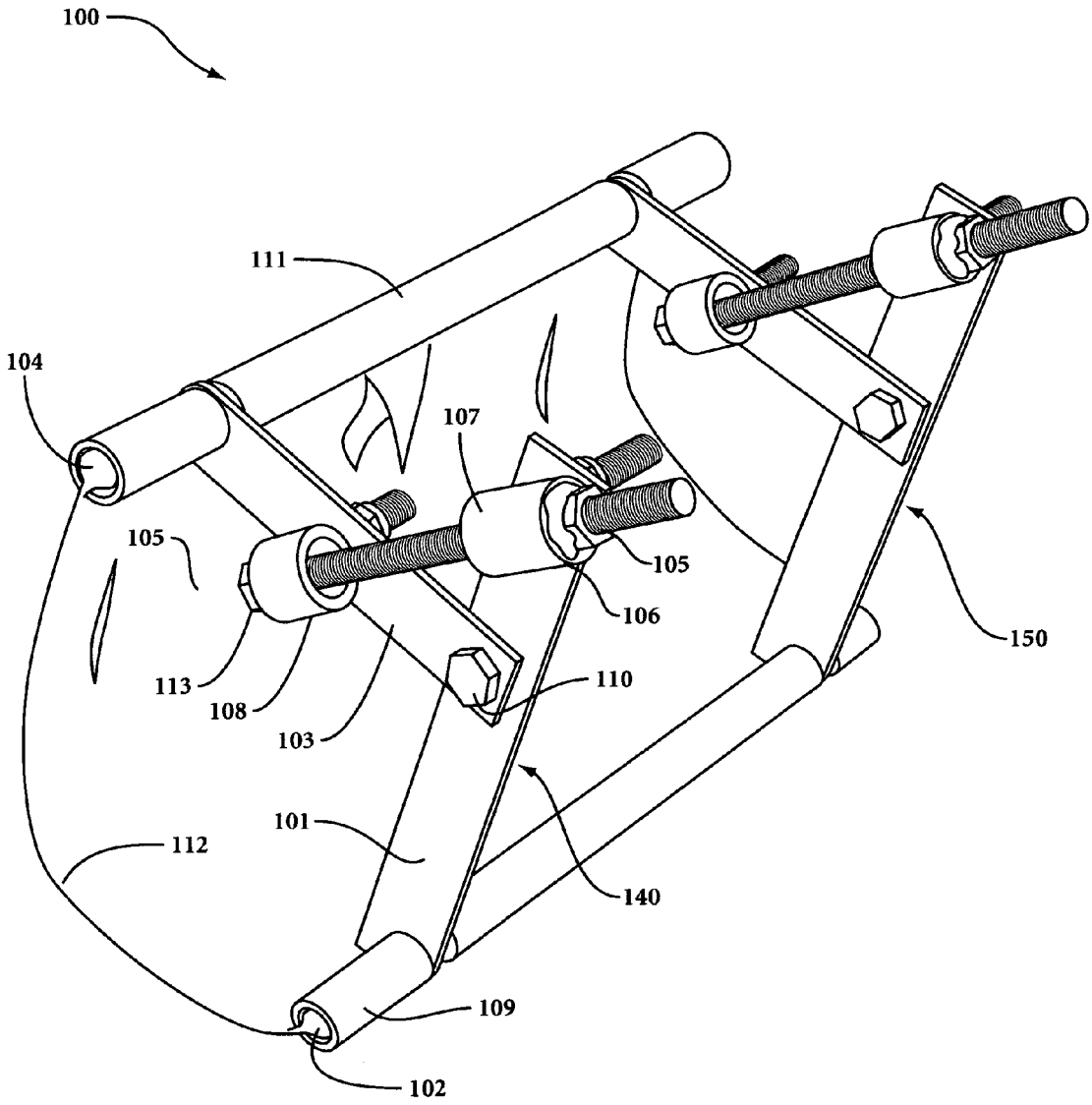
FIG. 5 is an overall view of an alternate embodiment of the expandable street curb inlet filter.
Figure 6:
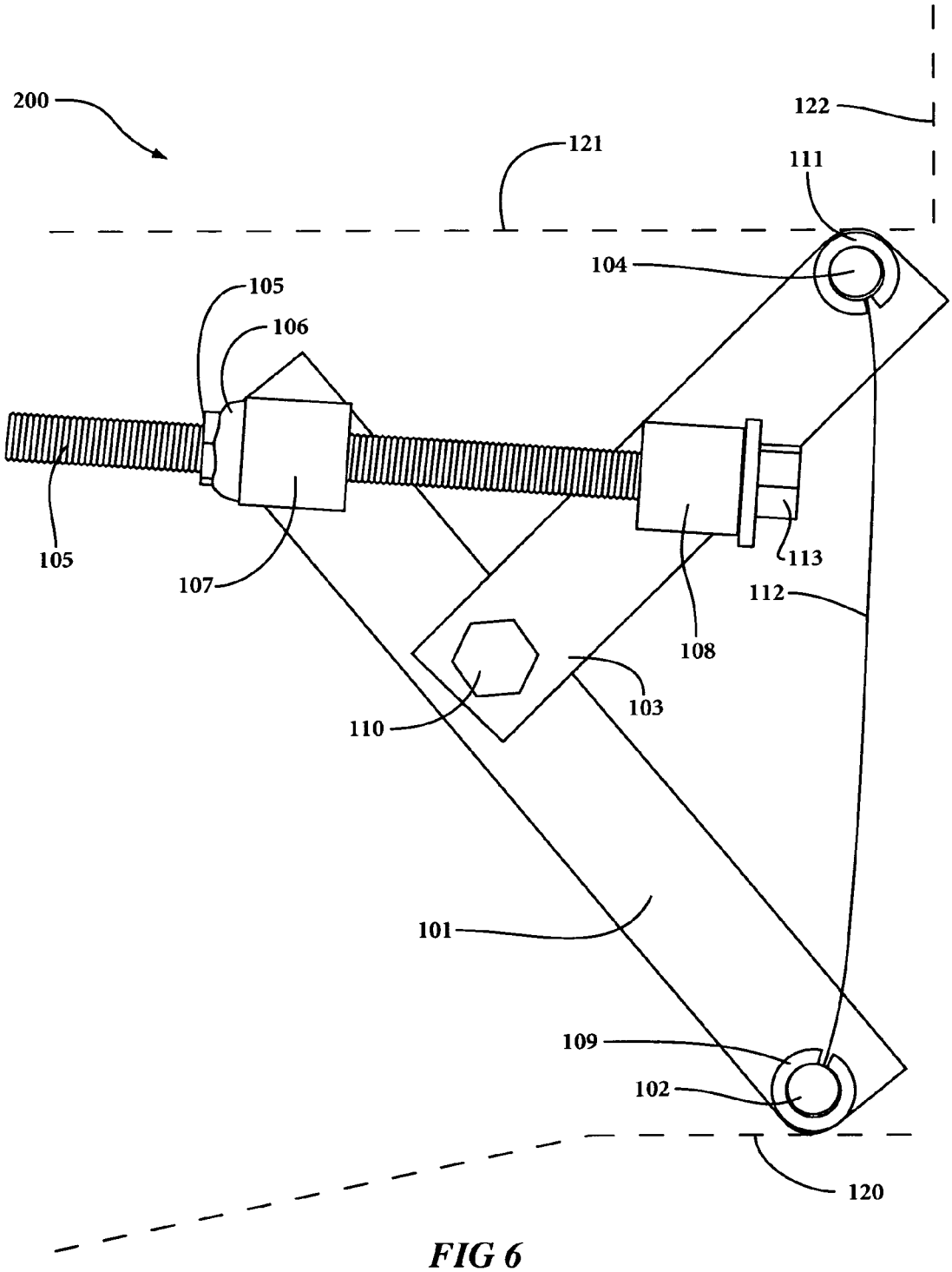
FIG. 6 illustrates another embodiment of an individual bracket of the expandable street curb inlet filter.

FIGS. 1-4 show one aspect of configuring the threaded fasteners. In another aspect the orientation of the threaded fastener bolts 105 can be changed to face in the opposite direction to achieve the same functional results. FIG. 5 shows such an orientation. In this embodiment the orientation of the street curb inlet filter can be reversed so that the filter medium is facing outward to the street and the bolts are hidden. FIG. 6 illustrates an individual bracket for this configuration in more detail.

Figure 7:
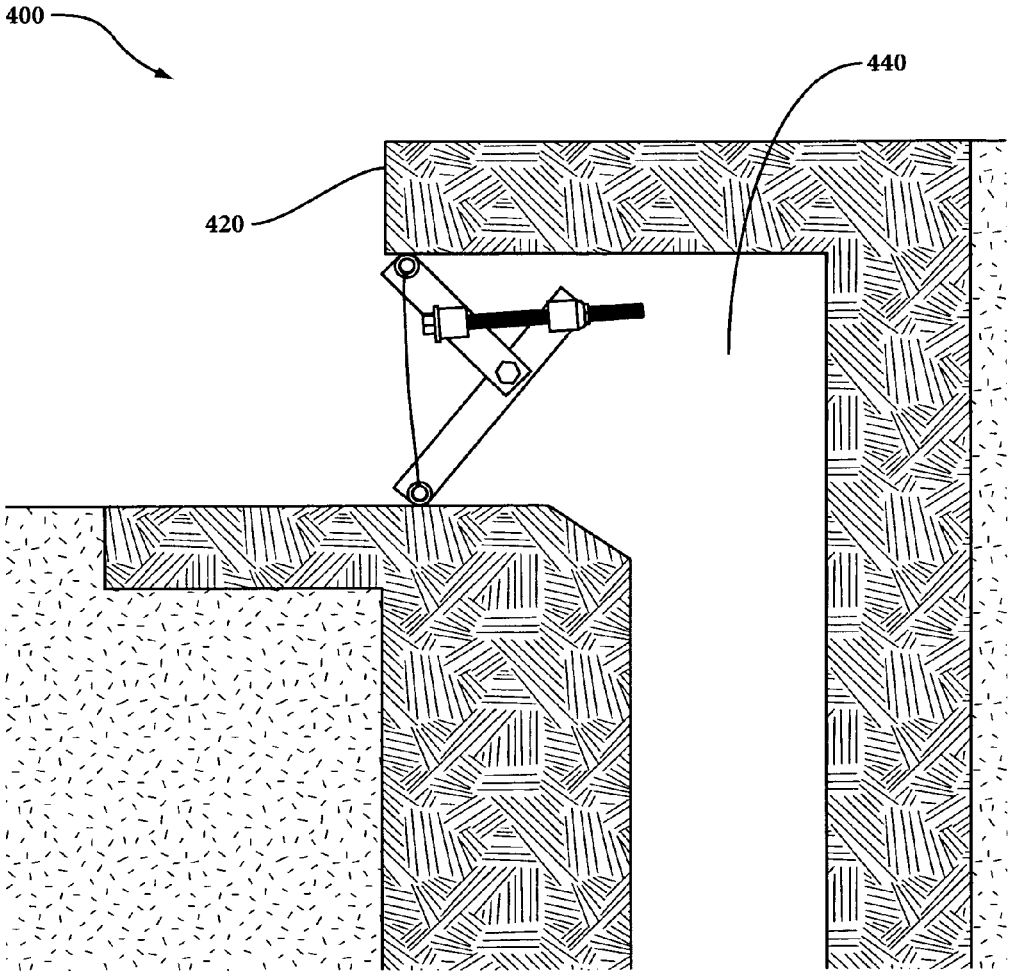
FIG. 7 illustrates an embodiment of an expandable street curb inlet filter deployed in a street curb inlet.
Figure 8:
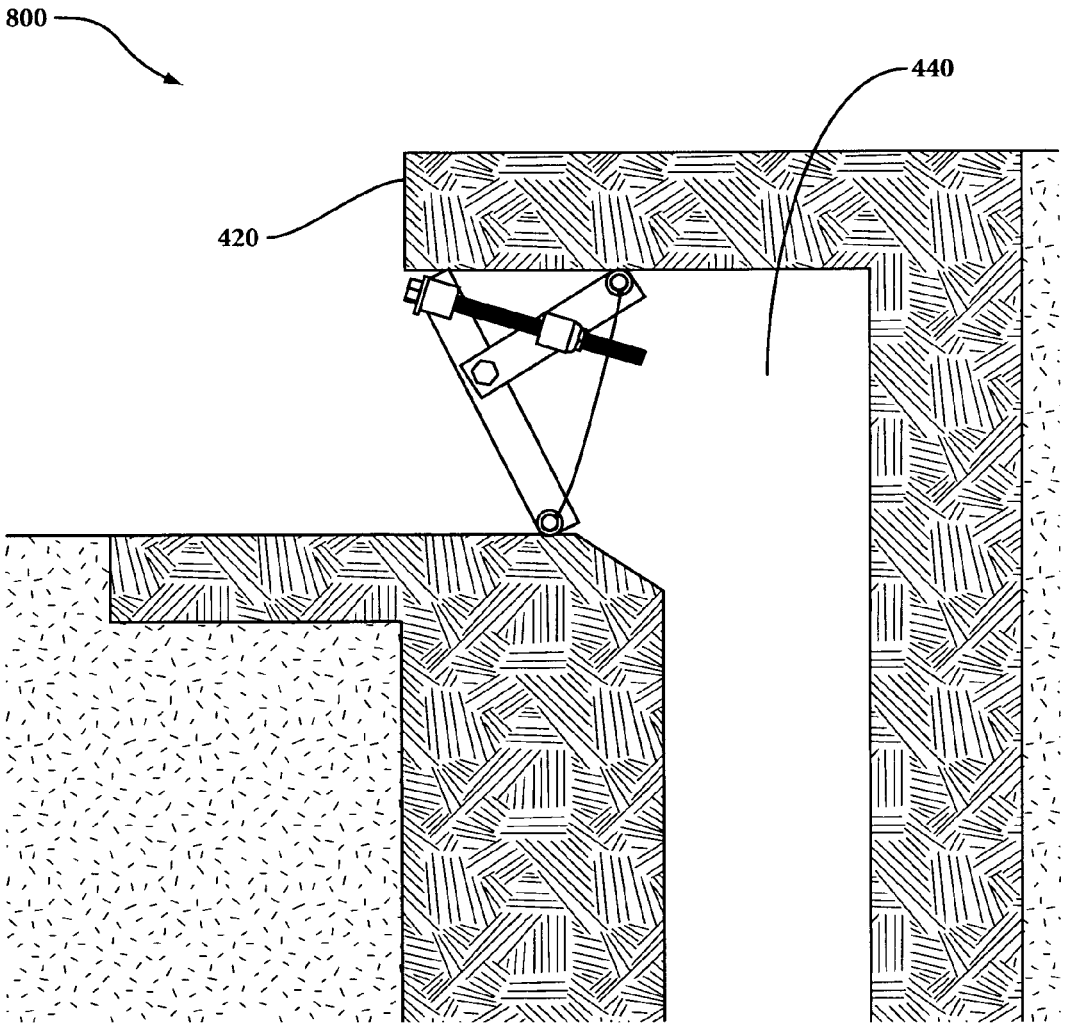
FIG. 8 illustrates an alternate embodiment of an expandable street curb inlet filter deployed in a street curb inlet.

The actual deployment of these alternate views are illustrated in FIGS. 7 and 8 in which FIG. 7 illustrates the deployment 400 of the FIG. 5 embodiment. The inlet filter is deployed inside the face 420 of curb inlet 440. FIG. 8 illustrates the deployment 800 of the FIG. 1 embodiment. The inlet filter is again deployed inside the face 420 of curb inlet 440.

The expandable street curb inlet filter as illustrated in FIGS. 1 thru 8 and described above can be easily inserted into a street curb inlet and simply tightened into a rigid configuration and provide robust filtering of incoming water and do so with no part of the mechanism extending out into the street—thus avoiding the common problem of prior art systems of being dislodged by street cleaning equipment or creating safety hazards to passersby.

While the present invention has been described in some detail, according to the preferred embodiments illustrated above, it is not meant to be limiting to modifications such as would be obvious to those skilled in the art.

The invention claimed is:

1. An expandable street curb inlet filter for filtering debris flowing into a street curb inlet having a top and a base, comprising:

a. a rigid frame strut having a first guided sleeve pivotally attached on a first end and rigidly connected at a second end to a first extended rod;

b. a rigid compression strut pivotally connected at a first end at a point between the first and second end of said rigid frame strut and fixedly connected at its second end to a second extended rod;

c. a second guided sleeve pivotally attached between said first end and said second end of said rigid compression strut; said second guided sleeve fixedly attached to a threaded nut;

d. a threaded fastener passing through said first guided sleeve and said threaded nut of said second guided sleeve;

e. a filter medium attached fixedly between said first and second extended rods;

f. wherein said threaded fastener, when tightened, moves said rigid compression strut upwards in a reverse scissor movement to separate said first and second extended rods and deploy said filter medium and seal said first and second rods against said top and base of said street curb inlet.

2. The expandable street curb inlet filter of claim 1 wherein said filter medium comprises a landscape fabric.

3. The expandable street curb inlet filter of claim 1 wherein said filter medium comprises a wire mesh fabric.

4. The expandable street curb inlet filter of claim 1 wherein said first and second extended rods are metallic.

5. The expandable street curb inlet filter of claim 1 wherein said first and second extended rods are hardened polymers.

6. An expandable street curb inlet filter for filtering debris flowing into a street curb inlet having a top and a base, comprising:

a. a rigid frame strut having a first guided sleeve pivotally attached on a first end and fixedly connected at a second end to a first extended rod;

b. a rigid compression strut pivotally connected at a first end at a point between the first and second end of said rigid frame strut and fixedly connected at its second end to a second extended rod;

c. a second guided sleeve pivotally attached between said first end and said second end of said rigid compression strut;

d. a threaded turnbuckle assembly connected to said first guided sleeve and said second guided sleeve;

e. a filter medium attached fixedly between said first and second extended rods;

f. wherein said threaded turnbuckle assembly, when tightened, moves said rigid compression strut upwards in a reverse scissor movement to separate said first and second extended rods and deploy said filter medium and seal said first and second rods against said top and base of said street curb inlet.

7. The expandable street curb inlet filter of claim 6 wherein said filter medium comprises a landscape fabric.

8. The expandable street curb inlet filter of claim 6 wherein said filter medium comprises a wire mesh fabric.

9. The expandable street curb inlet filter of claim 6 wherein said first and second extended rods are metallic.

10. The expandable street curb inlet filter of claim 6 wherein said first and second extended rods are hardened polymers.

11. An expandable street curb inlet filter for filtering debris flowing into a street curb inlet having a top and a base, comprising:

a. a rigid frame strut having a first guided sleeve pivotally attached on a first end and rigidly connected at a second end to a first extended rod; said first guided sleeve fixedly attached to a threaded nut;

b. a rigid compression strut pivotally connected at a first end at a point between the first and second end of said rigid frame strut and fixedly connected at its second end to a second extended rod;

c. a second guided sleeve pivotally attached between said first end and said second end of said rigid compression strut;

d. a threaded fastener passing through said second guided sleeve and said threaded nut of said first guided sleeve;

e. a filter medium attached fixedly between said first and second extended rods;

f. wherein said threaded fastener, when tightened, moves said rigid compression strut upwards in a reverse scissor movement to separate said first and second extended rods and deploy said filter medium and seal said first and second rods against said top and base of said street curb inlet.

12. The expandable street curb inlet filter of claim 11 wherein said filter medium comprises a landscape fabric.

13. The expandable street curb inlet filter of claim 11 wherein said filter medium comprises a wire mesh fabric.

14. The expandable street curb inlet filter of claim 11 wherein said first and second extended rods are metallic.

15. The expandable street curb inlet filter of claim 11 wherein said first and second extended rods are hardened polymers.

16. A method for filtering debris flowing into a street curb inlet having a top and a base, comprising the steps of:

a. providing a rigid frame strut having a first guided sleeve pivotally attached on a first end and fixedly connected at a second end to a first extended rod;

b. providing a rigid compression strut pivotally connected at a first end at a point between the first and second end of said rigid frame strut and fixedly connected at its second end to a second extended rod;

c. providing a second guided sleeve pivotally attached between said first end and said second end of said rigid compression strut;

d. providing a filter medium attached fixedly between said first and second extended rods;

e. providing a driving force that moves said rigid compression strut upwards in a reverse scissor movement to separate said first and second extended rods and deploy said filter medium and seal said first and second rods against said top and base of said street curb inlet.

17. The method for filtering debris flowing into a street curb inlet having a top and a base of claim 16 wherein said second guided sleeve is fixedly attached to a threaded nut; and wherein a threaded fastener passes through said first guided sleeve and said threaded nut of said second guided sleeve; and wherein the driving force that moves said rigid compression strut upwards in a reverse scissor movement is provided by tightening the threaded fastener.

18. The method of filtering debris flowing into a street curb inlet having a top and a base of claim 16 wherein said first guided sleeve is fixedly attached to a threaded nut; and wherein a threaded fastener passes through said second guided sleeve and said threaded nut of said first guided sleeve; and wherein the driving force that moves said rigid compression strut upwards in a reverse scissor movement is provided by tightening the threaded fastener.

* * * * *